US008177033B2

(12) United States Patent
Kauppinen et al.

(10) Patent No.: US 8,177,033 B2
(45) Date of Patent: May 15, 2012

(54) TRANSPORTATION SYSTEM WITH CAPACITIVE ENERGY STORAGE AND NON-VOLATILE MEMORY FOR STORING THE OPERATIONAL STATE OF THE TRANSPORTATION SYSTEM UPON DETECTION OF THE OPERATIONAL ANOMALY IN POWER

(75) Inventors: Tuukka Kauppinen, Hyvinkää (FI); Jyrki Laaksonheimo, Hyvinkää (FI); Pekka Hytti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/175,020

(22) Filed: Jul. 1, 2011

(65) Prior Publication Data

US 2011/0290593 A1 Dec. 1, 2011

Related U.S. Application Data

(63) Continuation of application No. PCT/FI2010/000001, filed on Jan. 4, 2010.

(30) Foreign Application Priority Data

Jan. 12, 2009 (FI) ..... 20090008

(51) Int. Cl.
*B66B 1/06* (2006.01)

(52) U.S. Cl. ..... 187/290; 187/391

(58) Field of Classification Search ..... 187/247, 187/248, 290, 293, 296, 297, 391–393
See application file for complete search history.

(56) References Cited

U.S. PATENT DOCUMENTS

| | | | | |
|---|---|---|---|---|
| 4,124,103 | A | 11/1978 | Otto et al. | |
| 4,627,518 | A | 12/1986 | Meguerdichian et al. | |
| 4,754,851 | A | 7/1988 | Suzuki | |
| 5,085,294 | A * | 2/1992 | Iwata | 187/394 |
| 5,274,203 | A * | 12/1993 | Skalski et al. | 187/393 |
| 6,742,630 | B2 * | 6/2004 | Eilinger | 187/290 |
| 6,938,733 | B2 * | 9/2005 | Eilinger | 187/290 |
| 7,003,620 | B2 * | 2/2006 | Avraham et al. | 711/103 |
| 7,014,014 | B2 * | 3/2006 | Mueller | 187/305 |
| 7,331,426 | B2 * | 2/2008 | Jahkonen | 187/290 |
| 7,453,169 | B2 * | 11/2008 | Grundmann et al. | 307/64 |
| 7,549,515 | B2 * | 6/2009 | Tegtmeier et al. | 187/288 |
| 7,681,694 | B2 * | 3/2010 | Aulanko et al. | 187/290 |

FOREIGN PATENT DOCUMENTS

| | | | |
|---|---|---|---|
| EP | 0 471 348 | A1 | 2/1992 |
| EP | 1 035 637 | A2 | 9/2000 |
| JP | 02305780 | A * | 12/1990 |
| JP | 7-271681 | A | 10/1995 |
| JP | 9-322430 | A | 12/1997 |
| JP | 11-222365 | A | 8/1999 |

* cited by examiner

*Primary Examiner* — Anthony Salata
(74) *Attorney, Agent, or Firm* — Birch, Stewart, Kolasch & Birch, LLP

(57) ABSTRACT

A transportation system and a method are provided for backing up the operational state of a transportation system. The transportation system includes a control apparatus for controlling the operation of the transportation system. The control apparatus further includes capacitive energy storage and a power supply backup circuit adapted to maintain power supply from the said energy storage to a storage circuit for a given length of time in connection with an operational anomaly in power supply to the control apparatus.

13 Claims, 3 Drawing Sheets

3: Storage circuit
4: Microcontroller with memory
5: Power supply circuit
6: Power supply backup circuit
7: Supercapacitors
13: Motion signal
14: Messages
16: Elevator car movement control unit
19: Electric network
23: Control electronics 1: Elevator system
2: Control apparatus
13: Velocity detector
16: Control unit
17: Control unit
18: Control unit
19: Electric network
20: Frequency converter
21: Drive sheave
22: Elevator 3: Storage circuit
4: Microcontroller with memory
5: Power supply circuit
6: Power supply backup circuit
7: Supercapacitors
13: Motion signal
14: Messages
16: Elevator car movement control unit
19: Electric network
23: Control electronics 5: Power supply circuit
6: Power supply backup circuit
7: Supercapacitors
8: Voltage equalizing circuit
9: Charging resistor
10: Fuse
15,15': Diodes
19: Electric network

TRANSPORTATION SYSTEM WITH CAPACITIVE ENERGY STORAGE AND NON-VOLATILE MEMORY FOR STORING THE OPERATIONAL STATE OF THE TRANSPORTATION SYSTEM UPON DETECTION OF THE OPERATIONAL ANOMALY IN POWER

CROSS REFERENCE TO RELATED APPLICATIONS

This application is a Continuation of PCT/FI2010/000001 filed on Jan. 4, 2010, which claims priority of application Ser. No. FI20090008 filed in Finland on Jan. 12, 2009, all of which are hereby expressly incorporated by reference into the present application.

BACKGROUND OF THE INVENTION

1. Field of the Invention

The present invention relates to a transportation system and to a method for backing up the operational state of a transportation system.

2. Background of the Invention

In transportation systems, such as an elevator system, usually battery backup is used in order to enable selected system functions to be maintained even during a power failure. If an elevator car is carrying passengers at the onset of a power failure, battery backup can be used to maintain a communication connection from the elevator car to a maintenance center; similarly, power can be supplied from the battery for illumination of the elevator car. For such purposes, the battery is generally fitted in conjunction with the elevator car, e.g. on the top of the elevator car.

One of the problems with battery backup is unreliability of batteries. Batteries deteriorate in a short time, and the number of charge/discharge cycles they can tolerate is quite limited. Moreover, e.g. ambient temperature has an effect on the service life of batteries and also restricts their service conditions.

In many types of electronic applications, there has in recent years emerged the use of so-called supercapacitors, which are also called ultracapacitors or double-layer capacitors. There are different types of supercapacitors, depending on the principle and material of manufacture, but a feature characteristic of all these is a high energy storing capacity. As compared to conventional capacitors, the square area of the charge surfaces of supercapacitors has often been increased by using active carbon or some other solution increasing the square area. Supercapacitors usually have an energy storing capacity several tens or even hundreds of times higher as compared to conventional capacitors.

Publication JP 9322430 proposes an arrangement that uses a battery with a supercapacitor fitted in parallel with it in order to reduce the number of battery charge/discharge cycles so as to increase the service life of the battery.

Publication JP 7271681 proposes a solution where power is supplied to a semiconductor memory device from a battery or alternatively from a supercapacitor.

SUMMARY OF THE INVENTION

The object of the invention is to solve the above-mentioned problems as well as problems appearing from the description of the invention presented below. To this end, the present invention proposes a new type of solution for backing up the operational state of a transportation system in connection with an operational anomaly in power supply.

Other embodiments of the invention are characterized by what is disclosed in the other claims. Inventive embodiments are also presented disclosed in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. The features of different embodiments of the invention can be applied in connection with other embodiments within the scope of the basic inventive concept.

The transportation system of the invention includes a control apparatus for controlling the operation of the transportation system. The control apparatus comprises a storage circuit having a non-volatile memory for storing the operational state of the transportation system. The control apparatus is also provided with a power supply backup circuit comprising a capacitive energy storage. The power supply backup circuit is adapted to maintain supply of power from the energy storage to the storage circuit for a given length of time in connection with an operational anomaly in power supply to the control apparatus. Thus, when the supply of power to the control apparatus is interrupted, the power supply backup circuit can maintain power supply to the storage circuit for a given length of time after the instant of interruption of the supply of power. It is thus possible to store parameters describing the operational state of the transportation system into the non-volatile memory of the storage circuit even after the interruption of power supply. A parameter describing the operational state of the transportation system is e.g. motion data of the transportation system, such as velocity, acceleration/deceleration and position of the transportation system and/or the motor driving the transportation system, and e.g. the positional angle between rotor and stator of the motor driving the transportation system. In connection with an interruption of power supply to the transportation system, the mechanical brake of the transportation system is engaged to decelerate the motion of the transportation system. In this case, the motion data of the braking transportation system can be updated as described in the invention even after an interruption of power supply to the transportation system, and the updated motion data can be stored into the non-volatile memory in spite of the power failure. In this connection, 'non-volatile memory' refers to a memory which preserves the data stored in it despite an interruption of power supply. After the power failure, the motion data can thus be restored from the non-volatile memory, and the restored motion data can be used for control of the operation of the transportation system. For example, the exact position angle between the rotor and stator of the electromotor driving the transportation apparatus can be restored in this way, so the position angle can be controlled without an absolute detector in spite of a power failure. Other parameters determining the operational state of the control devices of the transportation system can also be stored into and restored from the non-volatile memory in a corresponding manner. The transportation system referred to here may be e.g. a passenger or service elevator system, an escalator system, a moving walkway system, a roller hoist system, a crane system, a vehicle system, or a conveyor system for transportation of goods and/or raw materials. In this connection, 'transportation apparatus' refers to that part of the transportation system by means of which the object to be transported is moved.

The aforesaid non-volatile memory may be e.g. an EEPROM memory, a flash memory or a corresponding semiconductor memory, which preserves the data stored in it even after an interruption of power supply to the memory. The non-volatile memory may also contain other data, such as the software of the control apparatus of the transportation system. The storage circuit and its memory may consist of several components, or it may also be integrated as a single component. The storage circuit may also comprise e.g. a microcontroller.

According to one or more embodiments, the storage circuit is adapted to store the operational state of the transportation system when the power supply backup circuit is supplying power to the storage circuit.

In an embodiment of the invention, the power supply backup circuit comprises a supercapacitor, which serves as a capacitive energy storage. The use of a supercapacitor as an energy source during an operational anomaly in power supply is advantageous because the number of charge/discharge cycles of a supercapacitor is not limited as e.g. in the case of batteries. The service life of supercapacitors is therefore also longer than that of batteries, which naturally improves the reliability of power supply backup; improved reliability of power supply backup again increases the reliability and safety of the transportation system. The operating ambient temperature range of supercapacitors is also wider than that of batteries, and they tolerate low temperatures better than batteries.

If a voltage equalizing circuit is fitted in parallel with a supercapacitor, then it is possible to series-connect several supercapacitors with equalizing circuits. In such a connection, the function of the voltage equalizing circuits is, on the one hand, to equalize the voltages of the series-connected capacitors to the same value and, on the other hand, to limit the voltage of the capacitor fitted in parallel with the equalizing circuit to the highest voltage boundary value allowed. The voltage tolerance of supercapacitors is typically quite low, only about two to three volts, so the terminal-to-terminal voltage of supercapacitors can be increased via series-connection, and this may also make it easier to adapt the voltage to the rest of the current circuit.

According to one or more embodiments of the invention, the power supply backup circuit comprises a charging circuit and a discharging circuit for charging and discharging the aforesaid supercapacitor, and the charging circuit is fitted between the power supply circuit of the control apparatus and the power supply backup circuit.

According to one or more embodiments of the invention, the backup circuit comprises determination of the operational state of power supply to the control apparatus and, on detecting an operational anomaly in power supply, the storage circuit is adapted to store into the non-volatile memory at least one parameter describing the operational state of the transportation system.

According to one or more embodiments of the invention, the storage circuit is adapted to read a message generated by a control device of the transportation system and determining the operational state of the control device and to store this message into the non-volatile memory.

According to one or more embodiments of the invention, after the operational anomaly in power supply to the control apparatus has disappeared, the storage circuit is adapted to read from the non-volatile memory a parameter stored there in connection with the operational anomaly and describing the operational state of the transportation system.

According to one or more embodiments of the invention, power supply from the power supply circuit of the control apparatus to the storage circuit is interrupted by means of a switch in connection with an operational anomaly in power supply to the control apparatus.

In the method of the invention for backing up the operational state of a transportation system, a storage circuit having a non-volatile memory is fitted in a control apparatus controlling the transportation system; a power supply backup circuit is fitted in the control apparatus; a capacitive energy storage is fitted in the power supply backup circuit; and power is supplied from the aforesaid energy storage to the storage circuit for a given length of time in connection with an operational anomaly in power supply to the control apparatus of the transportation system.

Instead of a supercapacitor, the power supply backup can also be implemented using some other type of capacitor having a sufficient energy storing capacity. A possible capacitor type is electrolytic capacitor. Also, e.g. certain tantalite and ceramic capacitors have a quite good energy storing capacity.

BRIEF DESCRIPTION OF THE DRAWINGS

In the following, the invention is described in detail by referring to embodiment examples and the attached drawings, of which

DETAILED DESCRIPTION OF THE PREFERRED EMBODIMENTS

Figure 1:
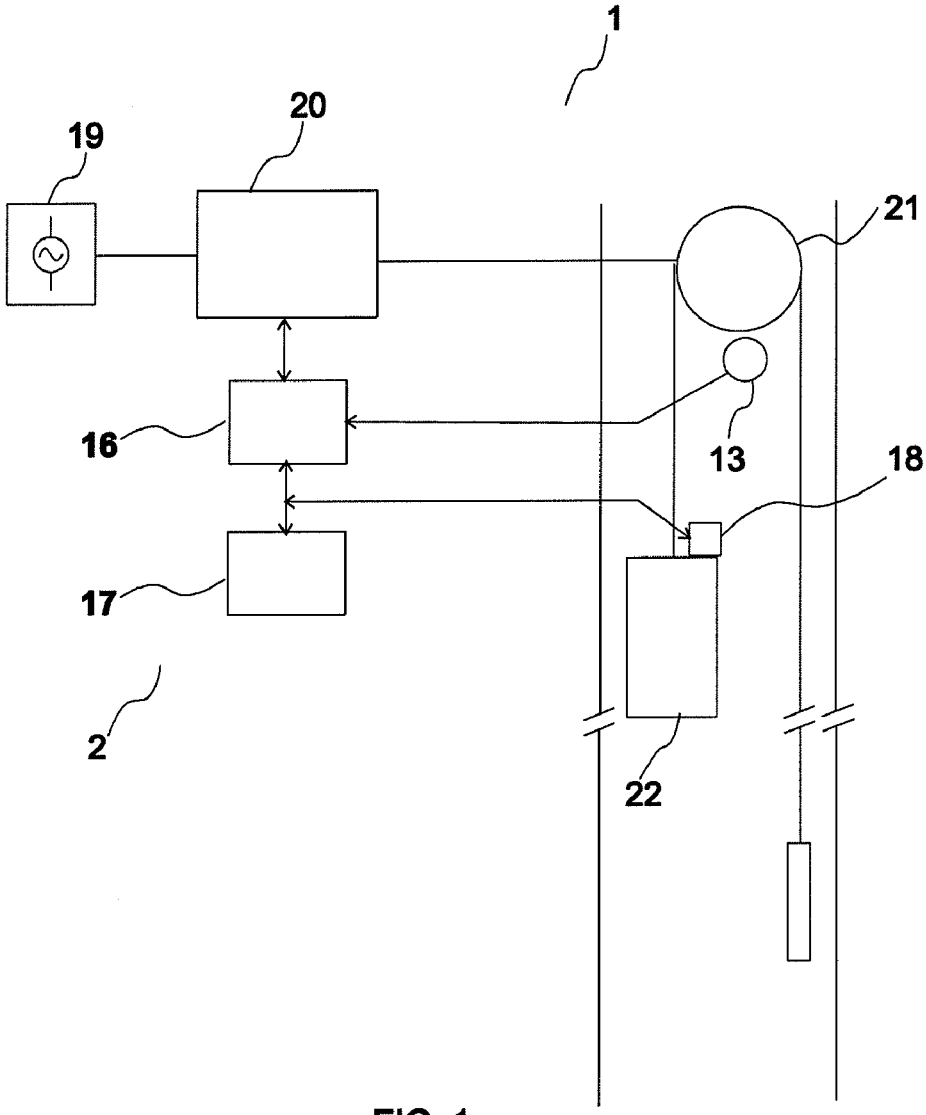
FIG. 1 represents an elevator system comprising an arrangement according to the invention fitted in it

In the elevator system according to FIG. 1, the elevator car 22 and counterweight are suspended by elevator ropes passed about the drive sheave 21 of the elevator motor. The elevator system 1 comprises a control apparatus 2 for controlling the operation of the elevator system. The electric motor driving the elevator car is supplied with power from an electric network 19 via a frequency converter 20. A control unit 16 controlling the movement of the elevator car again comprises a control loop, wherein the velocity 13 of the drive sheave of the elevator motor is measured by an encoder. The current supplied to the elevator motor is regulated by means of the frequency converter 20 so that the measured velocity 13 of the drive sheave is adjusted to a velocity corresponding to a velocity reference value. The velocity reference value is calculated as a function of the position of the elevator car moving in the elevator shaft. The control apparatus 2 of the elevator system also comprises a control unit 17 controlling traffic in the elevator system, one of the functions of said unit being to allocate the elevator calls to be served in accordance with allocation criteria applied in each situation. A control unit 18 fitted in conjunction with the elevator car takes care of e.g. the handling of car calls; in addition, there is fitted on the top of the elevator car a battery backup unit, from which power is supplied to the elevator system e.g. during a power failure. The elevator system control apparatus 2 also comprises various safety devices used to ensure safety of the elevator system both during normal operation and also in different anomalous or fault situations in the operation. Such safety devices are e.g. an elevator machine brake control unit, an elevator car overspeed monitoring unit and a landing door position monitoring unit (which are not shown in the figure).

The elevator system control apparatus 2 is supplied with power from an electric network 19 via the power supply circuit 5 of the control apparatus. The power supply circuit 5 of the control apparatus comprises an AC/DC converter, which converts the 230 V electric network voltage into a 24 V direct voltage signal for the control apparatus. Different control devices further comprise DC/DC converters, by means of which the 24 V direct voltage can be adapted according to the individual voltage and power requirement of each control device.

The elevator car movement control unit 16 comprises a microcontroller 4 having a non-volatile flash memory where the software of the movement control unit 16 is stored. Instead of a flash memory, the non-volatile memory used may also be an EEPROM memory or some other non-volatile semiconductor memory. The microcontroller 4 is also used to implement elevator car speed control. Therefore, the microcontroller repeatedly reads certain parameters describing the operational state of the elevator system, such as the motion signal 13 of the encoder of the elevator motor. In addition, the microcontroller calculates from the encoder signal the position angle between the rotor and stator of the elevator motor and also elevator car position data.

Figure 2:
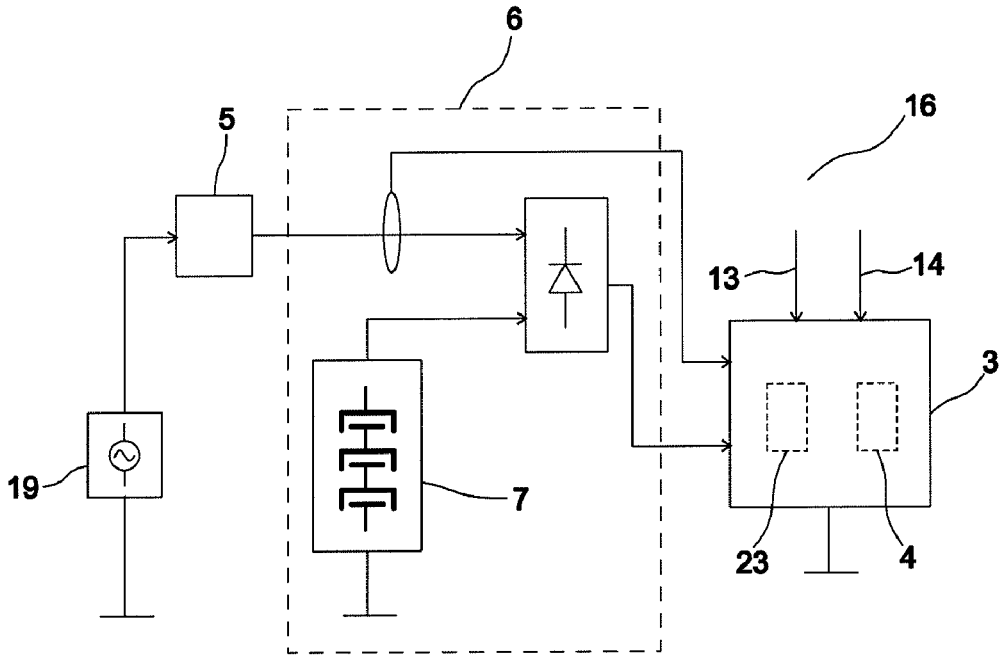
FIG. 2 represents an arrangement according to the invention for backing up the operational state of a transportation system

Fitted in the elevator car movement control unit 16 is a power supply backup circuit 6, which comprises an energy storage formed from supercapacitors 7. FIG. 2 represents a power supply backup circuit that may be used. The power supply backup circuit 6 is adapted to maintain supply of power from the supercapacitors 7 to the microcontroller 4 as well as to the components associated with the latter during an operational anomaly in power supply. During an operational anomaly in power supply, the microcontroller together with its associated components serves as a storage circuit 3. Thus, upon detecting an interruption in the supply of power from the power supply circuit 5, the microcontroller begins storing the position angle between rotor and stator calculated from the encoder signal as well as the elevator car position data into the flash memory. The microcontroller goes on storing these parameters describing the operational state of the elevator system until the movement of the elevator car is stopped by the elevator motor's machine brake, which was engaged at the onset of the power failure. When power supply is restored after the failure, the microcontroller reads from the flash memory the position angle between rotor and stator as well as the elevator car position data, which were preserved through the power failure. This enables the operation of the elevator system to be continued normally, without necessarily requiring any separate measures for determining the position angle/elevator car position data.

FIG. 2 represents an arrangement where the control apparatus of the transportation system comprises a power supply backup circuit 6 via which power is supplied to the storage circuit 3 in connection with an operational anomaly in power supply. During normal operation of the transportation system, the storage circuit 3 is supplied with power from the power supply circuit 5 of the control apparatus. The power supply backup circuit 6 comprises an energy storage 7 provided with mutually series-connected supercapacitors.

The control electronics 23 of the storage circuit 3 reads the signal indicating the operational state of the power supply circuit 5. Upon detecting an operational anomaly, the control electronics 23 begins storing the parameters indicating the operational state of the transportation system into the non-volatile memory 4. The parameters stored in connection with an operational anomaly in power supply comprise e.g. movement data 13 of the transportation apparatus. The storage circuit control electronics also reads messages 14 generated by the control devices of the transportation system and determining the operational state of the control devices, and the messages thus read are stored into the non-volatile memory 4. These messages may be e.g. status and failure messages, and the messages may also contain other data needed by the control devices, such as system and control parameters of the apparatus.

Figure 3:
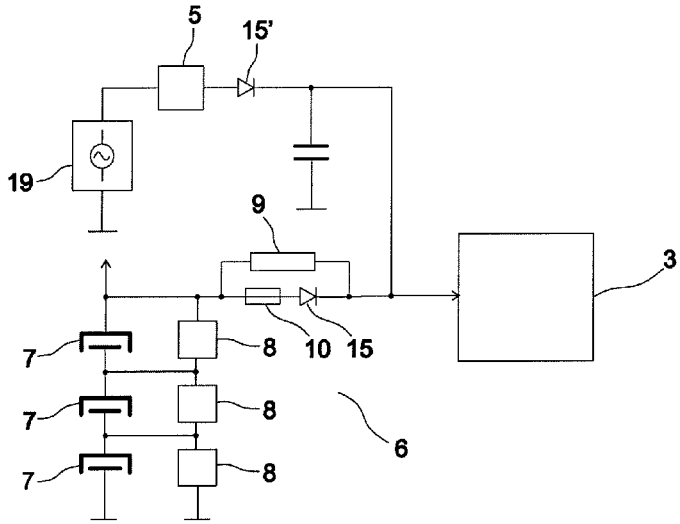
FIG. 3 represents a power supply backup circuit according to the invention

FIG. 3 represents a power supply backup circuit according to the invention. The backup circuit is applicable for use e.g. in the applications represented by FIGS. 1 and 2. The backup circuit comprises mutually series-connected supercapacitors 7, each of which has a voltage equalizing circuit 8 fitted in parallel with it. The voltage between the terminals of the energy storage thus formed is normally somewhat lower than the voltage of the power supply circuit 5 of the control apparatus. Power supply to the storage circuit 3 is therefore obtained from the power supply circuit of the control apparatus; at the same time, the supercapacitors 7 are charged with energy from the power supply circuit 5 via a charging resistor 9. If the voltage of the power supply circuit 5 of the control apparatus falls, then diode 15' is switched to the reverse blocking state and power supply to the storage circuit 3 is interrupted. Now the diode 15 fitted in parallel with the charging resistor 9 is turned on, and power supply to the storage circuit is maintained from the supercapacitors 7. Fitted in series with diode 15 is also a fuse 10, which serves as an overcurrent protector for the supercapacitors e.g. in a short circuit situation.

Figure 4:
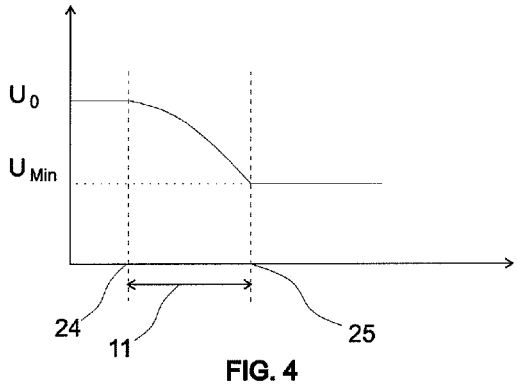
FIG. 4 represents the voltage between the terminals of a capacitive energy storage according to the invention

FIG. 4 represents the voltage measured across the series-connected supercapacitors as a function of time. The supercapacitors form a capacitive energy storage such as can be used e.g. in conjunction with the embodiment examples represented by FIGS. 1-3. At instant 24 shown in FIG. 4 there occurs an operational anomaly in power supply to the transportation system, with the result that the power supply backup circuit is engaged to maintain supply of power from the supercapacitors to the storage circuit. At the same time, the voltage of the supercapacitors starts falling from its initial value $U_0$. At instant 25, the voltage has fallen below the allowed minimum limit $U_{min}$, causing the under-voltage monitoring function of the storage circuit to interrupt the operation of the storage circuit. The rate of decrease of voltage depends on the power requirement $P_b$ of the storage circuit. The capacity of the supercapacitors is so selected that movement of the transportation system during an operational anomaly in power supply will have stopped within the operating time $t_b$ of the power supply backup circuit 6.

The required capacity C [F] of the supercapacitors can be solved from the equation below:

$$C = \frac{2P_b * t_b}{U_0^2 - U_{min}^2}$$

The invention has been described above by referring to a few embodiment examples. It is obvious to a person skilled in the art that the invention is not exclusively limited to the above-described examples, but that many other embodiments are possible within the scope of the inventive idea defined in the claims.

The invention claimed is:

1. A transportation system having a control apparatus for controlling the operation of the transportation system, wherein the control apparatus comprises:

a storage circuit provided with a non-volatile memory for storing an operational state of the transportation system; and a power supply backup circuit which comprises a capacitive energy storage, wherein the power supply backup circuit maintains power supplied from the capacitive energy storage to the storage circuit for a given length of time in connection with an operational anomaly in power supplied to the control apparatus, and upon detection of the operational anomaly in power supplied to the control apparatus, the non-volatile memory starts storing the operational state of the transportation system in the non-volatile memory until a movement of the transportation system stops.

2. The transportation system according to claim 1, wherein the operational state of the transportation system includes movement data of the transportation system and a position angle between a rotor and a stator.

3. The transportation system according to claim 1, wherein the said power supply backup circuit comprises a supercapacitor.

4. The transportation system according to claim 1, wherein the power supply backup circuit comprises at least two mutually series-connected supercapacitors, at least one of which has a voltage equalizing circuit fitted in parallel with it.

5. The transportation system according to claim 1, wherein the power supply backup circuit comprises a charging circuit and a discharging circuit for charging and discharging the supercapacitor, and the charging circuit is fitted between the power supply circuit of the control apparatus and the power supply backup circuit.

6. The transportation system according to claim 1, wherein the power supply backup circuit comprises determination of the operational state of power supply to the control apparatus and, on detecting the operational anomaly in power supply, the storage circuit stores into the non-volatile memory at least one parameter describing the operational state of the transportation system.

7. The transportation system according to claim 2, wherein the storage circuit is configured to read the movement data of the transportation system and the position angle between the rotor and the stator and to store the movement data of the transportation system and the position angle between the rotor and the stator into the non-volatile memory.

8. The transportation system according to claim 1, wherein the storage circuit reads a message generated by a control device of the transportation system and determines an operational state of the control device and to store the message into the non-volatile memory.

9. The transportation system according to claim 1, wherein after the operational anomaly in power supply to the control apparatus has disappeared, the storage circuit reads from the non-volatile memory a parameter in connection with the operational anomaly and describing the operational state of the transportation system.

10. The transportation system according to claim 1, wherein the power supplied from the power supply circuit of the control apparatus to the storage circuit is interrupted by a switch in connection with the operational anomaly in power supplied to the control apparatus.

11. The transportation system according to claim 1, wherein the non-volatile memory is an EEPROM and/or flash memory.

12. A method for backing up an operational state of a transportation system, wherein a storage circuit having a non-volatile memory is located in a control apparatus of the transportation system, a power supply backup circuit is located in the control apparatus, and a capacitive energy storage is located in the power supply backup circuit, the method comprising:

supplying power from the capacitive energy storage to the storage circuit for a given length of time in connection with the operational anomaly in power supplied to the control apparatus of the transportation system; and upon detection of the operational anomaly in power supplied to the control apparatus, starting storing the operational state of the transportation system into the non-volatile memory until a movement of the transportation system stops.

13. The method of claim 12, wherein the operational state of the transportation system includes movement data of the transportation system and a position angle between a rotor and a stator.

* * * * *